United States Patent [19]

Hedley

[11] Patent Number: 4,762,741

[45] Date of Patent: Aug. 9, 1988

[54] NON-SLIP FLOOR MAT COMBINATION

[75] Inventor: Terence M. Hedley, Leighton Buzzard, United Kingdom

[73] Assignee: Walk Off Mats Limited, Bedfordshire, United Kingdom

[21] Appl. No.: 101,052

[22] Filed: Sep. 25, 1987

[30] Foreign Application Priority Data

Sep. 26, 1986 [GB] United Kingdom ..... 8623165

[51] Int. Cl.[4] ..... B32B 5/16

[52] U.S. Cl. ..... 428/78; 428/90; 428/95

[58] Field of Search ..... 428/78, 90, 95

[56] References Cited

FOREIGN PATENT DOCUMENTS 252776 3/1925 United Kingdom .
686284 2/1951 United Kingdom .
1124292 7/1964 United Kingdom .
1227377 7/1968 United Kingdom .
2113993 1/1983 United Kingdom .

*Primary Examiner*—Marion C. McCamish
*Attorney, Agent, or Firm*—Howson & Howson

[57] ABSTRACT

A non-slip floor mat combination for use on pile-carpeted surfaces comprises a flexible, rubber-backed mat having a substantially flat preferably ultra smooth backing surface, and an anchoring component designed to be detachably secured through its lower surface to pile carpeting and having a substantially flat preferably ultra smooth upper surface designed to contact the backing surface of the mat and to restrict lateral movement of the mat relative to the anchoring component solely due to frictional resistance to relative movement between the two substantially flat surfaces in contact with one another.

7 Claims, No Drawings

NON-SLIP FLOOR MAT COMBINATION

The present invention relates to floor mats intended to be laid on pile-carpeted surfaces, more especially to floor mats intended to be laid temporarily on such surfaces and to be removed at intervals for cleaning as by washing or laundering, the so-called dust control mats. Conventionally, mats of this type are washable, flexible rubber-backed mats, usually having a pile fabric on at least the central area of their upper surface.

A rubber-backed floor mat placed on a pile-carpeted surface tends to creep during normal use. This movement is believed to be caused by the directional lie of the pile of the carpet which produces a frictional effect on the mat as pressure is applied by the foot different from the effect when pressure is released, so that the mat has a net movement in the direction in which the pile lies. A mat placed on such a carpet and walked over equally in two opposite directions will always move in one direction, which may be at an angle to the walking directions if the pile is not in line with the axis of the mat.

This 'creep' effect is sufficient to make it impractical to use a floor mat, especially a rubber-backed washable floor mat, on pile carpets without some means of preventing the movements taking place.

It has been proposed in our GB Patent Specification No. 2,115,693 to overcome this problem by forming the floor mat with one or more projections or recesses in its backing surface, these projections or recesses having side faces abutting against the side faces of complementary recesses or projections in an anchoring device or detent underlying the mat and detachably secured to the floor surface. However such a floor mat combination suffers from the drawback that specially produced floor mats must be used because the normal washable dust control mats do not have backing surfaces formed with projections or recesses.

It has also been proposed to attach to the back of a floor mat one or more anchoring devices which engage with the underlying carpeted surface to prevent creep but it is undesirable to use such attached devices when the mat itself is to be periodically removed and washed.

It has also been proposed to use as an anti-slip underlay for floor mats on deep pile carpets a lattice-like structure of textile material coated on one or both sides with an adhesive and flocked with fibres adhering to the elements of the lattice structure, the fibres engaging with the underside of the mat and the pile of the underlying carpet. However such an underlay does not provide a fully satisfactory answer either.

It would therefore be desirable to provide an alternative system which enables a standard washable mat with a substantially flat rubber backing surface to be used on pile-carpeted surfaces with a greatly reduced tendency to slip or creep.

Surprisingly, we have found that it is possible to eliminate almost all creep in use of a floor mat with a substantially flat backing surface by employing an anchoring component detachably secured to the pile carpeting and provided with a substantially flat upper surface, merely frictional resistance to relative movement between the substantially flat backing surface of the mat and the substantially flat upper surface of the anchoring component in contact with one another serving to inhibit creep.

When we refer to frictional resistance as being the sole means of restricting lateral movement of the mat relative to the anchoring component we mean to exclude the use of applied adhesives, the use of abutting side faces and the use of fibres or the like projecting from either surface to increase drag. We do not exclude the formation of an air-tight seal by close engagement of the two flat surfaces and its influence on preventing movement laterally.

According to the invention there is provided a floor mat combination for use on pile-carpeted surfaces to inhibit creep, comprising a flexible rubber-backed mat having a substantially flat backing surface, and an anchoring component designed to be detachably secured through its lower surface to pile carpeting and having a substantially flat upper surface designed to contact the backing surface of the mat and to restrict the anchoring component solely due to frictional resistance to relative movement between the substantially flat surfaces in contact with one another without the anchoring component being itself deformed.

Such a floor mat combination is much simpler and cheaper to produce than the combination disclosed in GB 2,115,693 and enables an ordinary washable, rubber-backed dust control mat to be used. Until the present invention was made it had not been appreciated that ordinary mats of this type could be used satisfactorily on pile-carpeted surfaces, although the problem of creep had been known for many years and the desirability of solving the problem had also been apparent. By use of the present invention, with the anchoring device arranged semi-permanently in position, it is possible to replace the initial mat by any other standard dust control mat whilst the initial mat is being washed and there is no need to ensure that an identical mat is used at all times. Where, as is frequently the case, the mats are owned by commercial contractcleaning organisations and hired to users, the ready interchangeability of the mats facilitates the business operations of the owner and avoids the need to keep track of individual mats to ensure that precisely the same mat is returned after cleaning.

In one preferred embodiment of the present invention the floor mat component of the combination is a conventional, washable, dust control mat having a substantially flat flexible backing surface formed of natural or synthetic rubber, which will withstand repeated washing or laundering in conventional machines, and usually one having a pile fabric on at least the central area of its upper surface embedded in the backing material by means of an intermediate tissue.

The mat usually has a size of at least 0.5 $m^2$, up to about 2 $m^2$, and a backing material thickness of 1 to 3 mm, corresponding to a weight per unit area (including pile fabric) of about 1.5 to 4 $kg/m^2$. Preferably, the backing to the mat is formed of nitrile rubber, which has the advantage of greater oil resistance than other rubber types such as natural rubber. Both nitrile and natural rubber have advantages of good flexibility and wear-resistance. The rubber used is suitably of medium hardness, for example of 55–65 IRHD. Plastics materials such as polyvinyl chloride are less satisfactory for backing purposes because they have handling or processing difficulties but their use is not ruled out.

Such mats may be made in a conventional manner involving a step of curing or vulcanising the rubber in a press mould using a release sheet to provide a substantially flat backing surface. Such a release sheet may be a woven glass fibre sheet coated with PTFE to give a substantially flat release surface.

The anchoring component in the combination according to the invention may be made of any material which provides a substantially flat upper surface and is sufficiently tough that it is not deformed, e.g. stretched or torn or damaged by water, when in service under the mat. Textile materials, paper and thin (less than 0.5 mm) plastics sheeting are examples of materials which are excluded under these criteria. Wood, metal and other totally rigid materials can be used and give good results, increasing as the hardness increases, but it is preferred to use a flexible material for ease of handling and transportation. Thicker plastics sheeting (e.g. 1–3 mm) of PVC or the like could be used but the best results have been obtained using a natural or synthetic rubber, for example a nitrile rubber. Amongst rubbers, better results in preventing creep of the mat are achieved as the hardness of the rubber increases towards 100 IRHD, but the use of very hard rubbers such as ebonite has the disadvantage that flexibility is lost. Preferably, therefore, a rubber having a hardness of 80 to 90 IRHD is used for the anchoring component, the difference in hardness between the mat component and the anchoring component being desirably at least 20 IRHD.

The anchoring component is preferably a unitary sheetlike anchoring device, although it is possible to use more than one smaller device with a single mat. Desirably, it remains covered by the mat whilst in service, so that its surface area should not be larger than the surface area of the mat. On the other hand, the best results in creep reduction are achieved when the anchoring component is as large as possible within that constraint, e.g. at least 85% or 90% of the surface area of the mat. For a rectangular mat of, for example, 50–100 cm × 100–200 cm a convenient size for the anchoring component is a rectangular, sheetlike pad 10 cm shorter in both dimensions, so as to leave a border of 5 cm all round when centrally placed under the mat.

If the anchoring component is too thin its creepinhibiting effect is reduced. Very thick anchoring components on the other hand cause a marked unevenness in the upper surface of the overlying mat and this is unsightly and can be dangerous, tripping unwary pedestrians. Preferably, therefore, the anchoring component is of comparable thickness to the mat, e.g. 1–2.5 or 3 mm. Its weight per unit area, in the case of a rubber anchoring pad, is preferably 1.5–3 kg/m$^2$. The rubber anchoring components can be made in the same way as the rubber mats, except for the pile fabric.

Especially good results are achieved if both the backing surface of the mat and the upper surface of the anchoring member are provided with ultra smooth surfaces such that when the surfaces are brought in contact a largely air-tight seal is formed. The resulting "striction" is then extremely effective in preventing all lateral movement. Such ultra smooth surfaces, which are so smooth that the rubber appears shiny, can be produced on rubber mats and anchoring pads by the use of commercially available ultra smooth release sheets during the manufacture of the mats and pads. The smoothness of a rubber surface in the context of the present invention may be judged by applying a small sample (e.g. 20–50 grams) to a vertical glass sheet such as a window pane. If the sample does not fall off or slide under its own weight it is sufficiently smooth for the purpose of the invention.

Alternatively, although this is less preferred, a matte or other surface pattern for example resembling close-mesh textile sheeting, may be applied to the back of the mat and the upper surface of the anchoring component. Any such surface pattern will have only insignificant peaks and troughs relative to the thickness of the mat, less than 10% and usually less than 2%, and there will be no significant interengagement of these peaks and troughs with troughs and peaks on the upper surface of the anchoring device so as to form an abutting relationship, contrary to the mat combinations described in our GB Patent Specification No. 2115693. We have found that a very close weave textile pattern gives better results than a coarse weave textile pattern although not nearly as good as ultra smooth surfaces, inhibiting creep to as little as 5% of the rate without an anchoring component.

The anchoring component can be detachably secured to the underlying pile-carpeted surface in any convenient manner. One very convenient manner is a double-sided tape but other methods would include complementary looped or hooked fabric such as Velcro attached to the back of the anchoring component and to the carpet or a non-woven fabric treated with a tacky latex adhesive. Yet another possibility is to flock the underside of the anchoring component with short fibres attached to an adhesive. These fibres will engage frictionally with an underlying pile carpet and will detachably secure the anchoring component to the carpet. As the anchoring component will normally be covered by the floor mat during use, it will not become dirty and will therefore not require cleaning at all or as often as the floor mat, so that there will be less need to detach the anchoring component from the carpet surface and hence less wear on the securing means.

One physical embodiment of the floor mat combination according to the invention consists of (a) a rectangular floor mat approximately 120 × 80 cm having a backing of nitrile (ABS) rubber (60 IRHD) approximately 1.5 mm thick and a pile fabric on its upper surface inside a border 10 cm wide, the total weight of the mat being 2 kg/m$^2$ (rubber) plus 0.8 kg/m$^2$ (fabric), and (b) an anchor pad approximately 110 × 70 cm formed of nitrile (ABS) rubber (IRHD 85) approximately 1.5 mm thick and of weight 2 kg/m$^2$.

The mating surfaces of the mat and pad are substantially flat and ultra smooth so that the rubber has a shiny appearance, substantially reflecting light and having the ability to reflect images. A sample of the pad weighing 40 grams applied to a vertical glass sheet remains held fast to it by friction and does not slide downwards under its own weight or drop off. The pad (b) may be secured to carpet surfaces by a double-sided tape, but in an alternative embodiment its underside is provided with a flocked fibrous surface to engage with the fibres on the carpet and thus avoid the need for use of adhesive tape.

What is claimed is:

1. A floor mat combination for use on pile-carpeted surfaces to inhibit creep, comprising a flexible rubber-backed mat having a substantially flat backing surface, and an anchoring component designed to be detachably secured through its lower surface to pile carpeting and having a substantially flat upper surface designed to contact the backing surface of the mat and to restrict lateral movement of the mat relative to the anchoring component solely due to frictional resistance to relative movement between the substantially flat surfaces in contact with one another without the anchoring component being itself deformed.

2. A combination as claimed in claim 1, wherein the anchoring component is a flexible sheetlike rubber pad.

3. A combination as claimed in claim 1, wherein the mat and anchoring component each have an ultra smooth surface on the surfaces designed to contact one another so that a substantially air-tight seal is formed when the surfaces are brought into contact with one another.

4. A combination as claimed in claim 1, wherein the anchoring component is provided on its lower surface with flocked fibres able to interengage frictionally with an underlying pile carpet to secure the anchoring component detachably to the carpet.

5. A combination as claimed in claim 1, wherein the surface area of the anchoring component is at least 80% but less than 100% of the surface area of the mat such that the mat totally covers the anchoring component when laid on top of it.

6. A combination as claimed in claim 1, wherein the mat and anchoring component are each 1 to 3 mm thick and each have a weight per unit area of from 1.5 to 4 $kg/m^2$.

7. A method of preventing creep of a floor mat on a pile-carpeted floor comprising detachably securing to the pile carpeting an anchoring component having a substantially flat upper surface and laying the floor mat, which has a substantially flat lower surface, on top of the anchoring device so that solely frictional resistance to relative movement between the two substantially flat surfaces in contact with one another restricts lateral movement of the mat, the anchoring component being formed of material which is not deformed when in service under the mat.

* * * * *